US008388091B2

(12) United States Patent
Matsui et al.

(10) Patent No.: US 8,388,091 B2
(45) Date of Patent: Mar. 5, 2013

(54) TRAY FOR INK JET PRINTER AND METHOD OF MANUFACTURING GOLF BALL HAVING MARK

(75) Inventors: Noriyuki Matsui, Kobe (JP); Masaaki Amasaki, Izumiohtsu (JP)

(73) Assignee: SRI Sports Limited, Kobe-Shi (JP)

( * ) Notice: Subject to any disclaimer, the term of this patent is extended or adjusted under 35 U.S.C. 154(b) by 570 days.

(21) Appl. No.: 12/650,940

(22) Filed: Dec. 31, 2009

(65) Prior Publication Data

US 2010/0182368 A1 Jul. 22, 2010

(30) Foreign Application Priority Data

Jan. 19, 2009 (JP) ..... 2009-008698

(51) Int. Cl.
*B41J 29/38* (2006.01)
*B41J 2/01* (2006.01)
*B41J 3/407* (2006.01)

(52) U.S. Cl. ..... 347/16; 347/104; 347/106

(58) Field of Classification Search ..... 347/16, 347/104, 106
See application file for complete search history.

(56) References Cited

U.S. PATENT DOCUMENTS 5,925,186 A 7/1999 Klimek
6,418,843 B1 * 7/2002 Givler ..... 101/35
2002/0139256 A1 10/2002 Ramey
2006/0050095 A1 3/2006 Kakuno et al.

FOREIGN PATENT DOCUMENTS

JP 2002-337329 A 11/2002
JP 2006-75253 A 3/2006
JP 2007-244669 A 9/2007
JP 2007244669 * 9/2007

OTHER PUBLICATIONS

Japanese Office Action dated Apr. 19, 2011 for Japanese Application No. 2009-008698.

* cited by examiner

*Primary Examiner* — Uyen Chau N Le
*Assistant Examiner* — Kajli Prince
(74) *Attorney, Agent, or Firm* — Birch, Stewart, Kolasch & Birch, LLP

(57) ABSTRACT

A tray 2 includes a holder 10 into which a golf ball is to be set. The holder 10 has: in an upper surface thereof and a lower surface thereof, openings 46 and 48 from which parts of the golf ball are exposed, respectively; and a contact portion 52 that comes into contact with the golf ball to fix in place the golf ball. The holder 10 is invertible. Preferably, the tray 2 further includes a base plate 12 on which the holder 10 is mounted. The base plate 12 has a stopper 72 that comes into contact with the golf ball set into the holder 10. The golf ball is fixed to the holder 10 such that the position of the center of the golf ball is caused to agree with the position of the center of the holder 10 in a thickness direction thereof due to this contact.

13 Claims, 17 Drawing Sheets

TRAY FOR INK JET PRINTER AND METHOD OF MANUFACTURING GOLF BALL HAVING MARK

This application claims priority on Patent Application No. 2009-8698 filed in JAPAN on Jan. 19, 2009. The entire contents of this Japanese Patent Application are hereby incorporated by reference.

BACKGROUND OF THE INVENTION

1. Field of the Invention

The present invention relates to trays for an ink jet printer and methods of manufacturing a golf ball having a mark.

2. Description of the Related Art

A golf ball manufacturer prints a mark on the surface of a golf ball and ships the golf ball. The mark includes characters, graphics, combinations of characters and graphics, and the like. Typically, the trademark of the golf ball is printed. The mark representing the trademark is referred to as a main mark. A user recognizes the type of the golf ball by identifying the main mark. In some cases, a mark corresponding to the user is also printed on the golf ball. The mark is referred to as an own name mark. Specific examples of the own name mark include the name of a user, a company name, a company badge, and a catchphrase. A lot in the case where the own name mark is printed is much smaller than a lot in the case where the main mark is printed.

A method of printing a mark on a golf ball includes a printing method of using an ink jet printer. One example of this printing method is disclosed in Japanese Laid-Open Patent Publication No. 2006-75253 (US 2006/050095).

In a conventional ink jet printer, a golf ball is merely put in an opening of a tray. The golf ball is not fixed to the tray, and thus the golf ball moves due to vibrations or the like during printing. This movement causes displacement of the golf ball. This movement also causes a deformed mark. The tray affects marking accuracy of the printer.

Because the tray cannot be inverted with a golf ball being fixed thereto, when marks are printed on both sides, it is not easy to form the marks on one side and the reverse side at positions symmetrical to each other. The tray has a problem that it is difficult to print a mark at a position desired by a user.

An objective of the present invention is to provide: a tray, for an ink jet printer, that can contribute to improvement of marking accuracy; and a method of manufacturing a golf ball having a mark.

SUMMARY OF THE INVENTION

A tray, for an ink jet printer, according to the present invention includes a holder into which a golf ball is set. The holder has: in an upper surface thereof, an opening from which a part of the golf ball is exposed; in a lower surface thereof, another opening from which another part of the golf ball is exposed; and a contact portion that comes into contact with the golf ball to fix in place the golf ball. The holder is invertible.

Preferably, in the tray for the ink jet printer, the holder further has an inner surface that surrounds the set golf ball. The contact portion projects inwardly from the inner surface. Preferably, the contact portion has a height of 0.3 mm or greater and 0.8 mm or less. Preferably, the contact portion is located so as to extend along a great circle of the set golf ball. Preferably, the contact portion is made of a ring-shaped member. Preferably, the contact portion has a diameter of 42.00 mm or greater and 42.20 mm or less. Preferably, the contact portion is an elastic body. Preferably, the contact portion has a hardness of 40 or greater and 70 or less. Preferably, a center of the contact portion in a thickness direction thereof is located at a position of a center of the holder in a thickness direction thereof. Preferably, the contact portion has a thickness of 2.90 mm or greater and 3.00 mm or less.

Preferably, the tray for the ink jet printer further includes a base plate on which the holder is mounted. The base plate has a stopper that comes into contact with the golf ball that has been set into the holder. The golf ball is fixed to the holder such that a position of a center of the golf ball is caused to agree with a position of a center of the holder in a thickness direction thereof due to this contact.

Preferably, in the tray for the ink jet printer, the stopper is a tapered hole that is shaped so as to be tapered downwardly.

Preferably, the tray for the ink jet printer further includes a clamp capable of fixing the holder to the base plate.

A method of manufacturing a golf ball having a mark, according to the present invention, includes the steps of:

(1) putting a golf ball in a holder that has: an opening located in an upper surface thereof; another opening located in a lower surface thereof; and a contact portion, exposing a part of the golf ball from the opening, exposing another part of the golf ball from the other opening, and causing the golf ball to come into contact with the contact portion, to fix the golf ball to the holder;

(2) supplying the holder to an ink jet printer and printing a mark at the part of the golf ball that has been exposed from the opening;

(3) inverting the holder with the golf ball, on which the mark has been printed, being fixed thereto; and (4) printing a mark at the other part of the golf ball that has been exposed from the other opening of the holder, by using the ink jet printer.

According to the tray, for the ink jet printer, according to the present invention, displacement of the golf ball does not occur. The tray can contribute to improvement of marking accuracy of the ink jet printer. According to the tray, the holder can be inverted with the golf ball being fixed thereto. Thus, printing on both sides with excellent marking accuracy is possible. The tray can contribute to improvement of customer satisfaction.

BRIEF DESCRIPTION OF THE DRAWINGS

FIG. 4(*b*) is an exploded side view of FIG. 4(*a*);

DESCRIPTION OF THE PREFERRED EMBODIMENTS

The following will describe in detail the present invention based on preferred embodiments with reference to the accompanying drawings.

Figure 1:
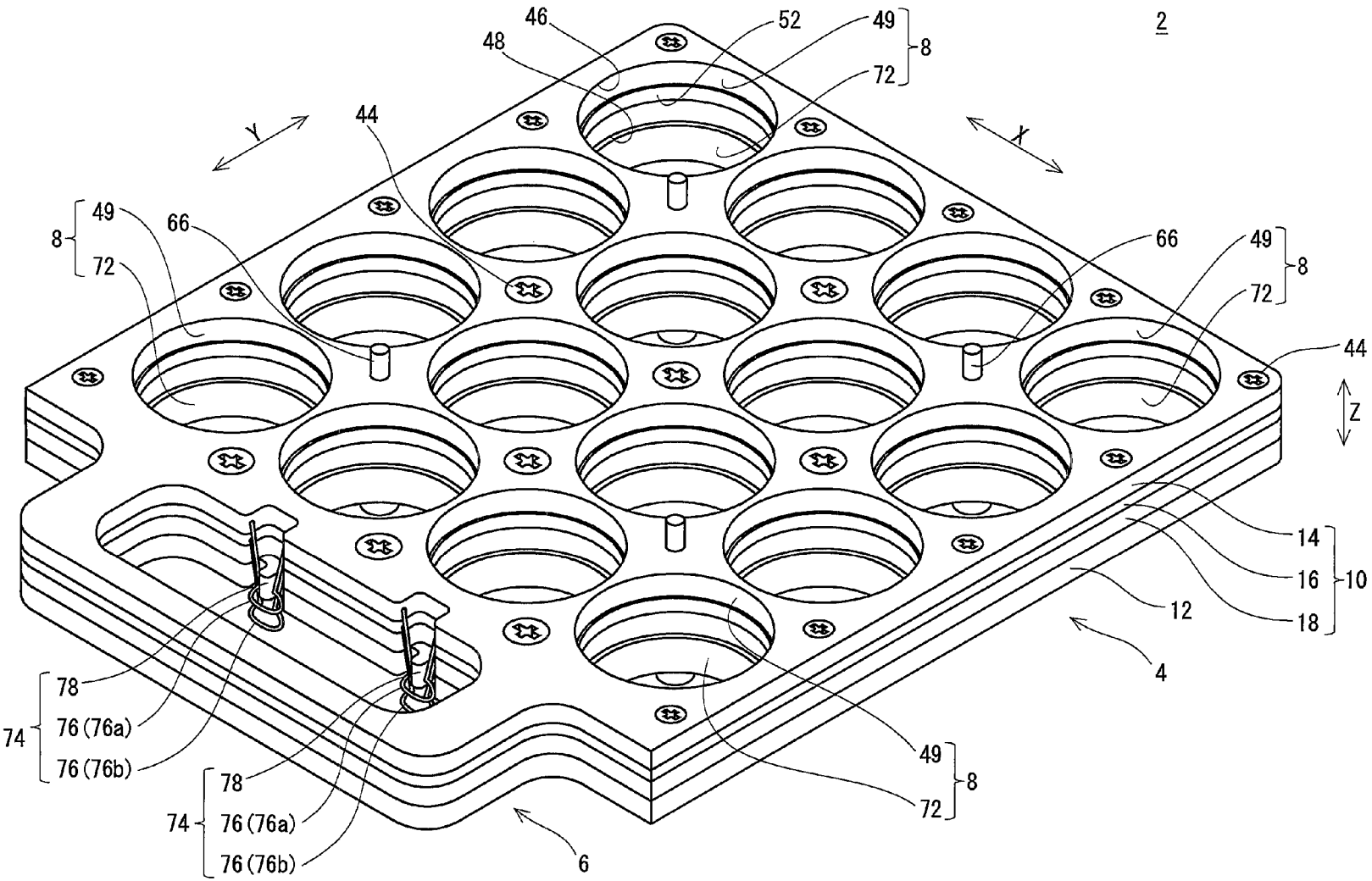
FIG. 1 is a perspective view of a tray, for an ink jet printer, according to an embodiment of the present invention.
Figure 2:
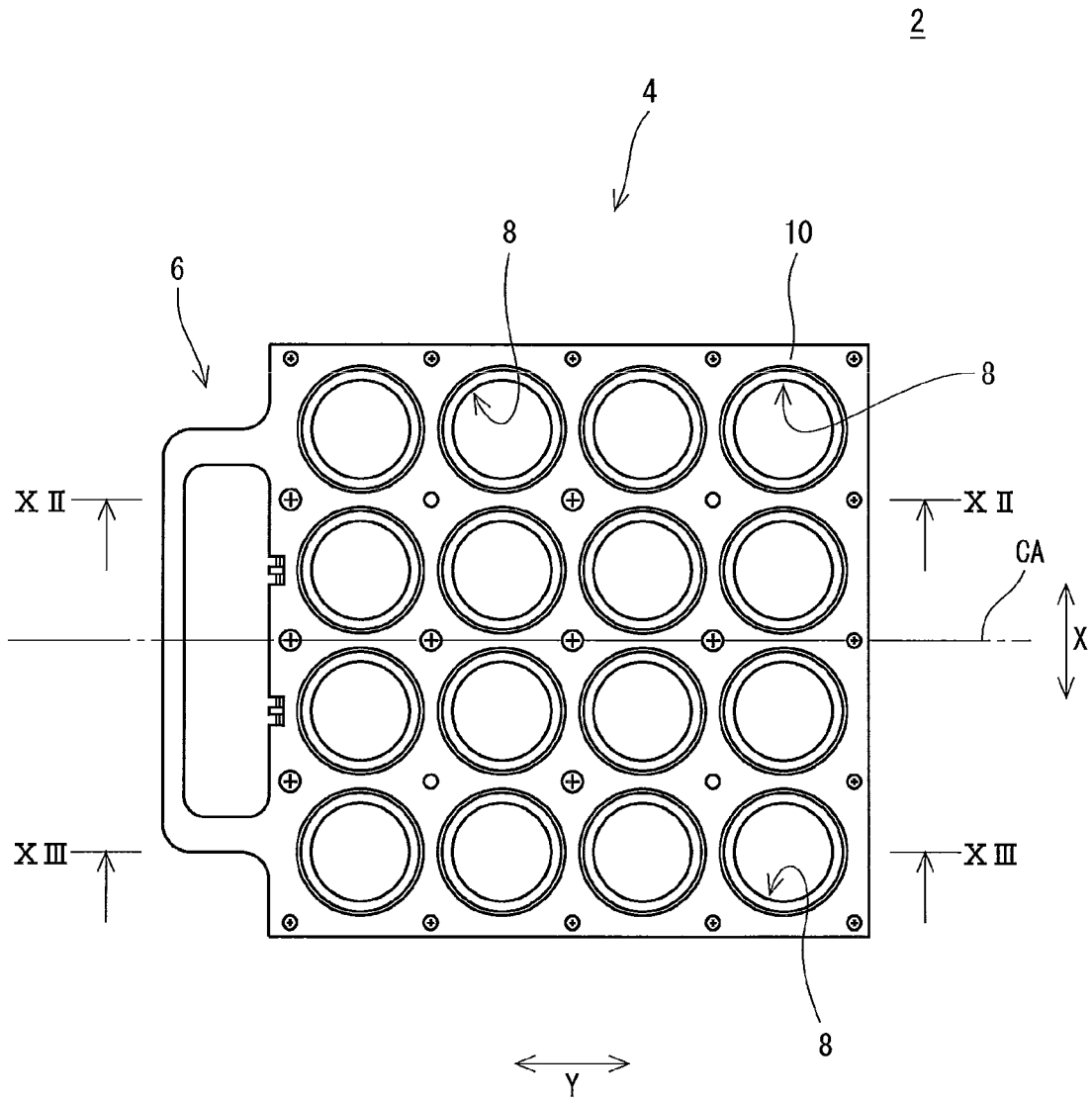
FIG. 2 is a plan view of the tray shown in FIG. 1.
Figure 3:
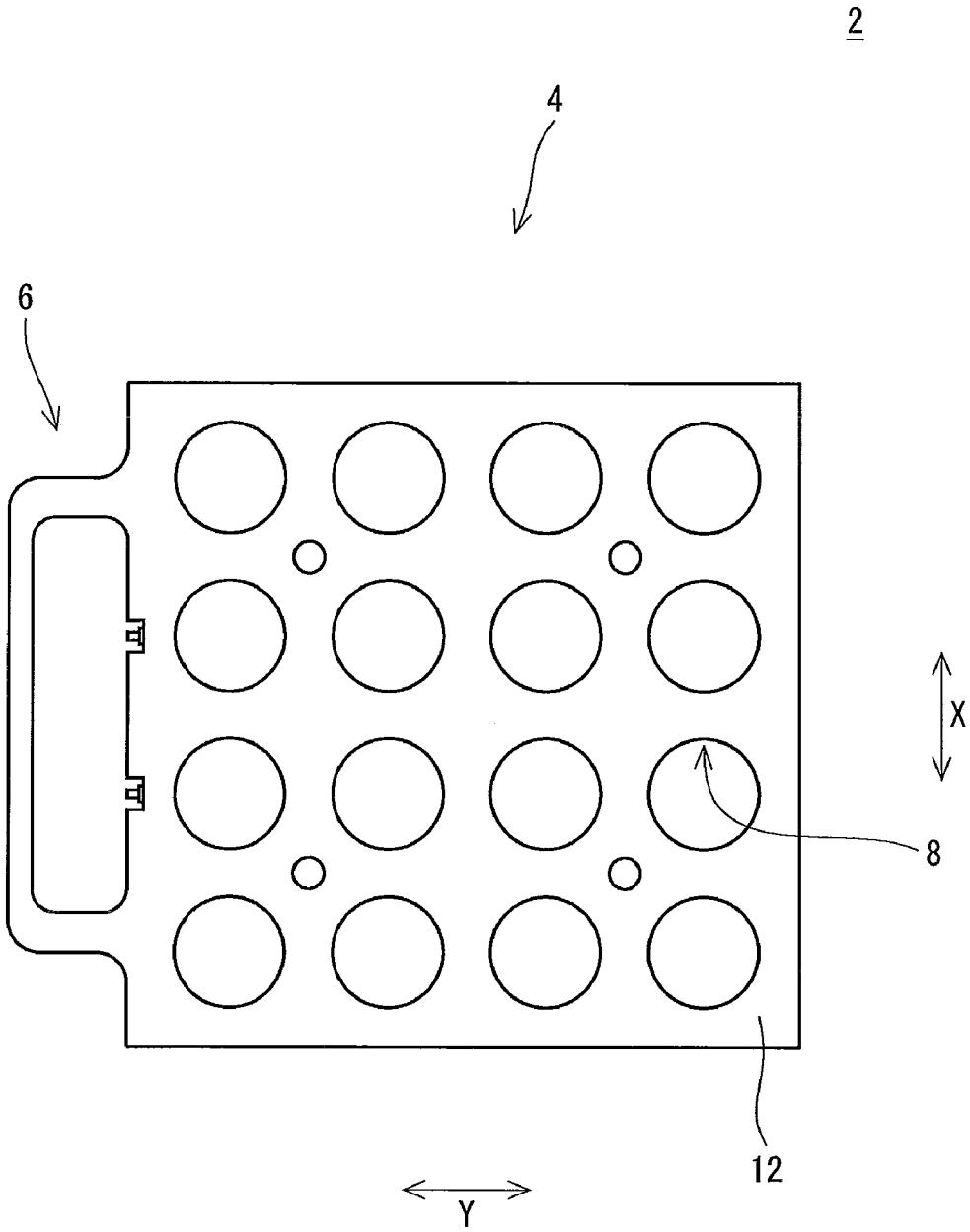
FIG. 3 is a bottom view of the tray shown in FIG. 1.

A tray 2, for an ink jet printer, shown in FIGS. 1 to 3 has a plate shape. Although not shown in the drawings, a golf ball on which a mark is to be printed by using the ink jet printer is to be set into the tray 2. An alternate long and short dash line CA represents the center line of the tray 2 in an X direction. A Z direction is the thickness direction of the tray 2.

The tray 2 includes a main body 4 and a grip 6. The main body 4 includes a plurality of cells 8. As shown in the drawings, the tray 2 is provided with 16 cells 8. The cells 8 are arranged in the tray 2 in a grid pattern. In the tray 2, four cells 8 are arranged in each line and at regular intervals in the X direction, and four cells 8 are arranged in each line and at regular intervals in a Y direction. Each of the cells 8 is made of a hole that extends through the tray 2 in a vertical direction. The golf ball is fitted into the cell 8. The grip 6 is grasped by a hand of a user who uses the ink jet printer. The user grasps the grip 6 and sets the tray 2 at the ink jet printer.

Figure 4:
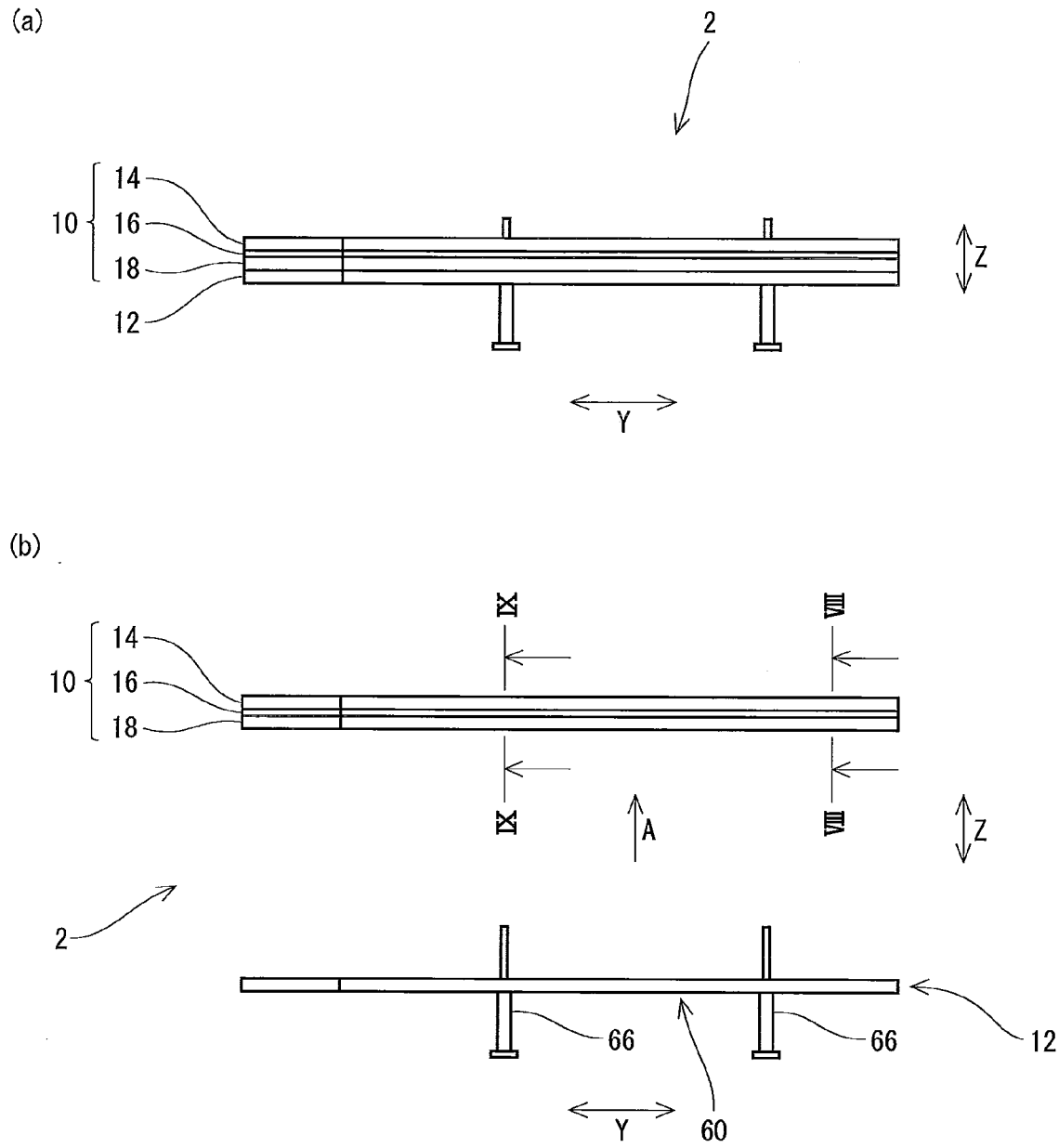
FIG. 4(*a*) is a side view of the tray shown in FIG. 1.

FIG. 4(*a*) is a side view of the tray 2, for the ink jet printer, shown in FIG. 1, and FIG. 4(*b*) is an exploded side view of FIG. 4(*a*).

The tray 2 includes a holder 10 and a base plate 12. The holder 10 is located on the upper side of the base plate 12. The holder 10 is mounted on the base plate 12. The holder 10 and the base plate 12 are not joined to each other. The tray 2 is formed such that the holder 10 and the base plate 12 can be separated from each other.

The holder 10 includes an upper plate 14, a mid plate 16, and a lower plate 18. The upper plate 14 is located on the upper side of the mid plate 16. The mid plate 16 is located on the upper side of the lower plate 18. The mid plate 16 is interposed between the upper plate 14 and the lower plate 18.

Figure 5:
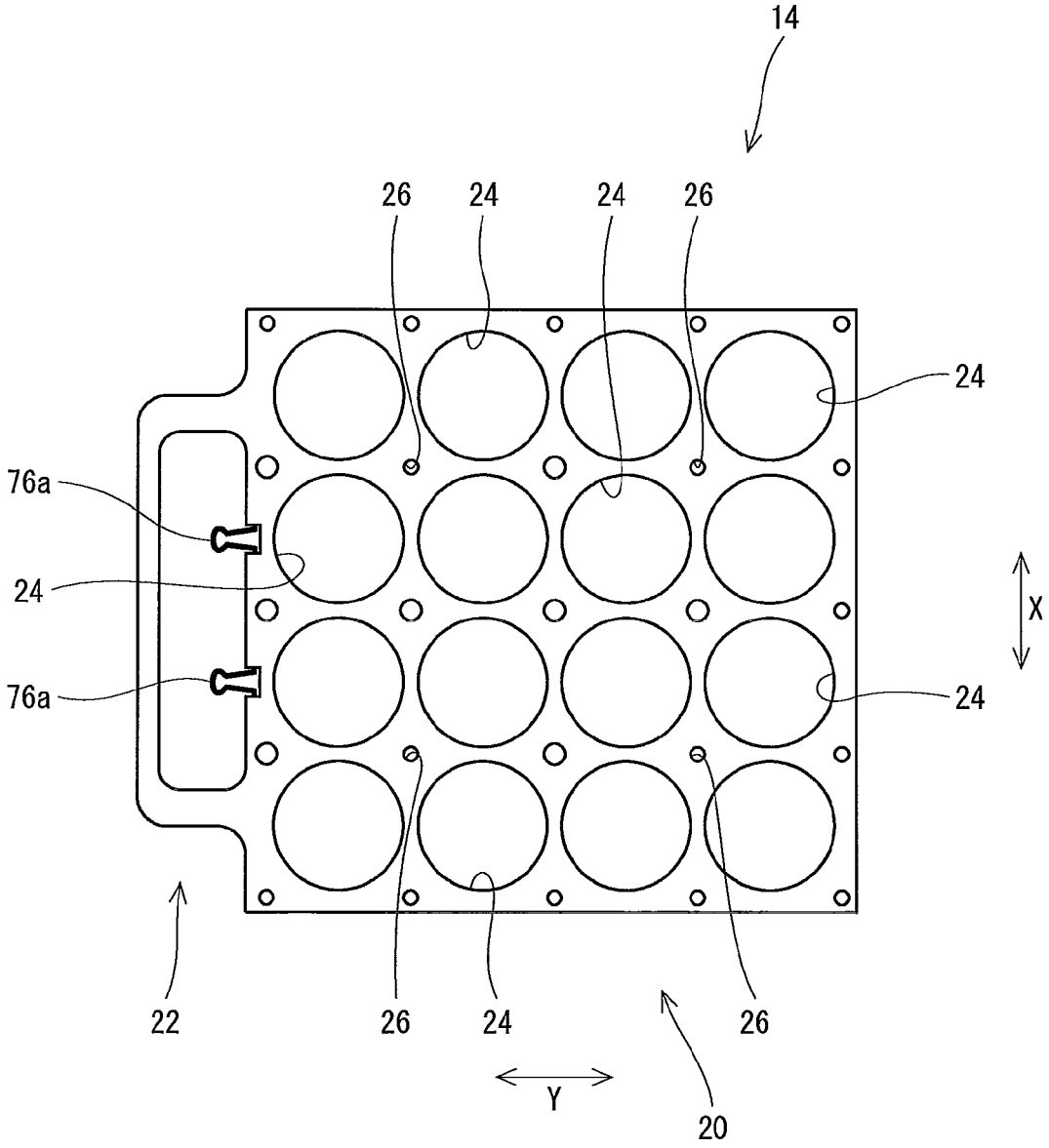
FIG. 5 is a plan view of an upper plate of the tray in FIG. 4.

FIG. 5 is a plan view of the upper plate 14 of the tray 2 in FIG. 4. The upper plate 14 is made of a substantially rectangular plate. The upper plate 14 includes a first main portion 20 and a first sub portion 22. The first main portion 20 and the first sub-portion 22 are integrally formed with each other. The first main portion 20 forms a part of the main body 4. The first sub-portion 22 forms a part of the grip 6.

The first main portion 20 has first main holes 24 and first sub-holes 26. The first main portion 20 is provided with 16 first main holes 24. As shown in the drawing, four first main holes 24 are arranged in each line and at regular intervals in the X direction, and four first main holes 24 are arranged in each line and at regular intervals in the Y direction. The first main holes 24 extend through the first main portion 20 in the vertical direction. Each first main hole 24 has a circular cross-sectional shape.

The first main portion 20 is provided with four first sub-holes 26. Four first main holes 24 are located around each of the first sub-holes 26. The first sub-holes 26 extend through the first main portion 20 in the vertical direction.

The upper plate 14 is formed by performing punching and the like on a plate that is formed from a resin composition. In the tray 2, in light of strength, the upper plate 14 is formed by processing a plate that is formed from a fiber-reinforced plastic. The upper plate 14 is hard.

Figure 6:
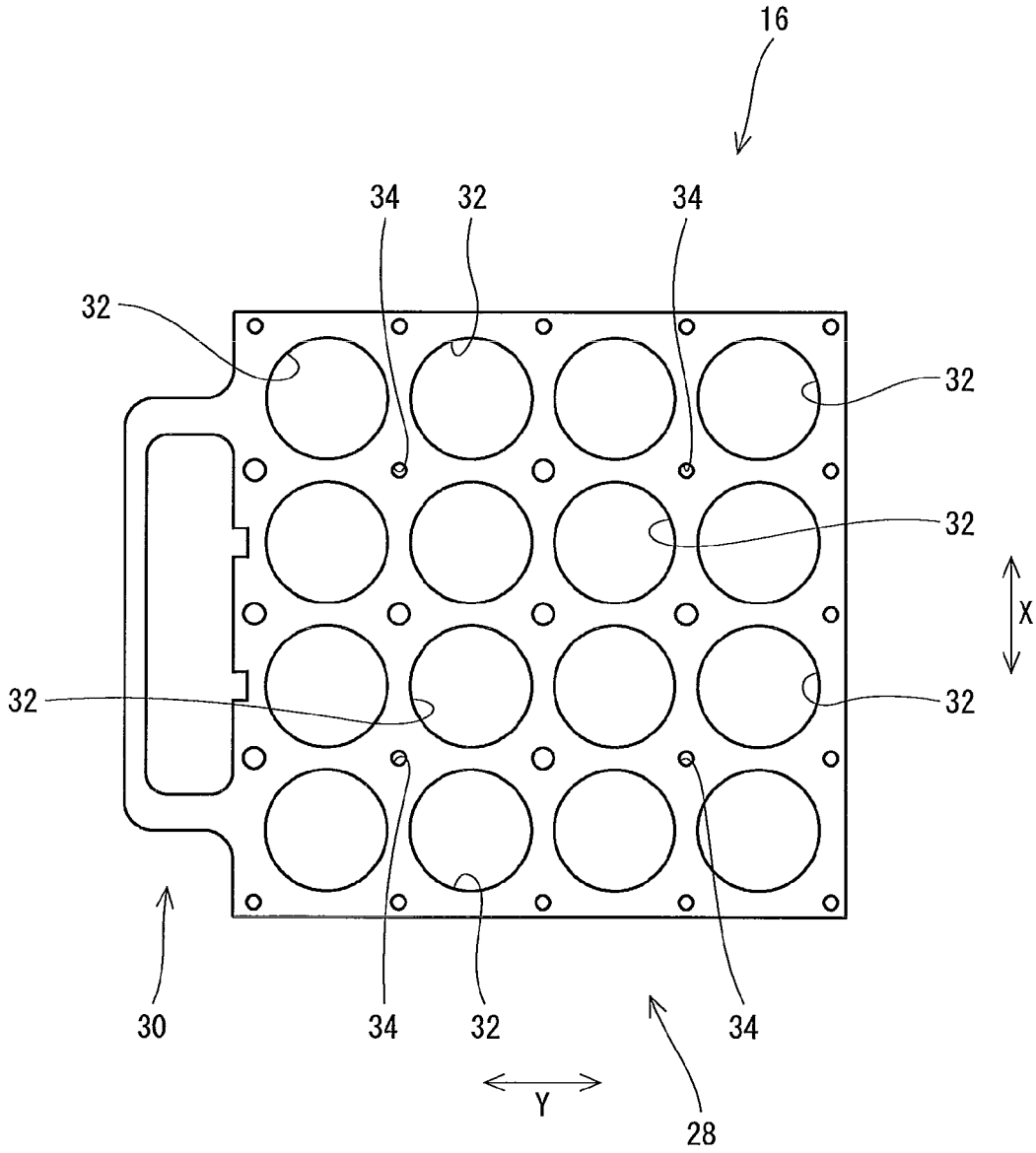
FIG. 6 is a plan view of a mid plate of the tray in FIG. 4.

FIG. 6 is a plan view of the mid plate 16 of the tray 2 in FIG. 4. The mid plate 16 is made of a substantially rectangular plate. The mid plate 16 deforms when a load is applied thereto, and restores when being released from the load. The mid plate 16 is an elastic body. The mid plate includes a second main portion 28 and a second sub-portion 30. The second main portion 28 and the second sub-portion 30 are integrally formed with each other. The second main portion 28 forms a part of the main body 4. The second sub-portion 30 forms a part of the grip 6.

The second main portion 28 includes second main holes 32 and second sub-holes 34. The second main portion 28 is provided with 16 second main holes 32. The second main holes 32 extend through the second main portion 28 in the vertical direction. Each second main hole 32 has a circular cross-sectional shape. As shown in the drawing, four second main holes 32 are arranged in each line and at regular intervals in the X direction, and four second main holes 32 are arranged in each line and at regular intervals in the Y direction. Each of the second main holes 32 is provided at a position corresponding to the lower side of the corresponding first main hole 24 of the upper plate 14 in a state where the upper plate 14 is mounted on the mid plate 16.

The second main portion 28 is provided with four second sub-holes 34. Four second main holes 32 are located around each of the second sub-holes 34. Each of the second sub-holes 34 is provided at a position corresponding to the lower side of the corresponding first sub-hole 26 of the upper plate 14 in the state where the upper plate 14 is mounted on the mid plate 16. The second sub-holes 34 extend through the second main portion 28 in the vertical direction.

The mid plate 16 is formed by performing punching and the like on a plate that is formed from a resin composition containing a thermoplastic resin. In light of easy deformation, thermoplastic polyamide elastomers, ethylene-methacrylic acid copolymers, ethylene-acrylic acid copolymers, thermoplastic polyester elastomers, thermoplastic polystyrene elastomers, and thermoplastic polyurethane elastomers are preferred as the thermoplastic resin. In light of wear resistance and grip performance, thermoplastic polyurethane elastomers are more preferred.

Figure 7:
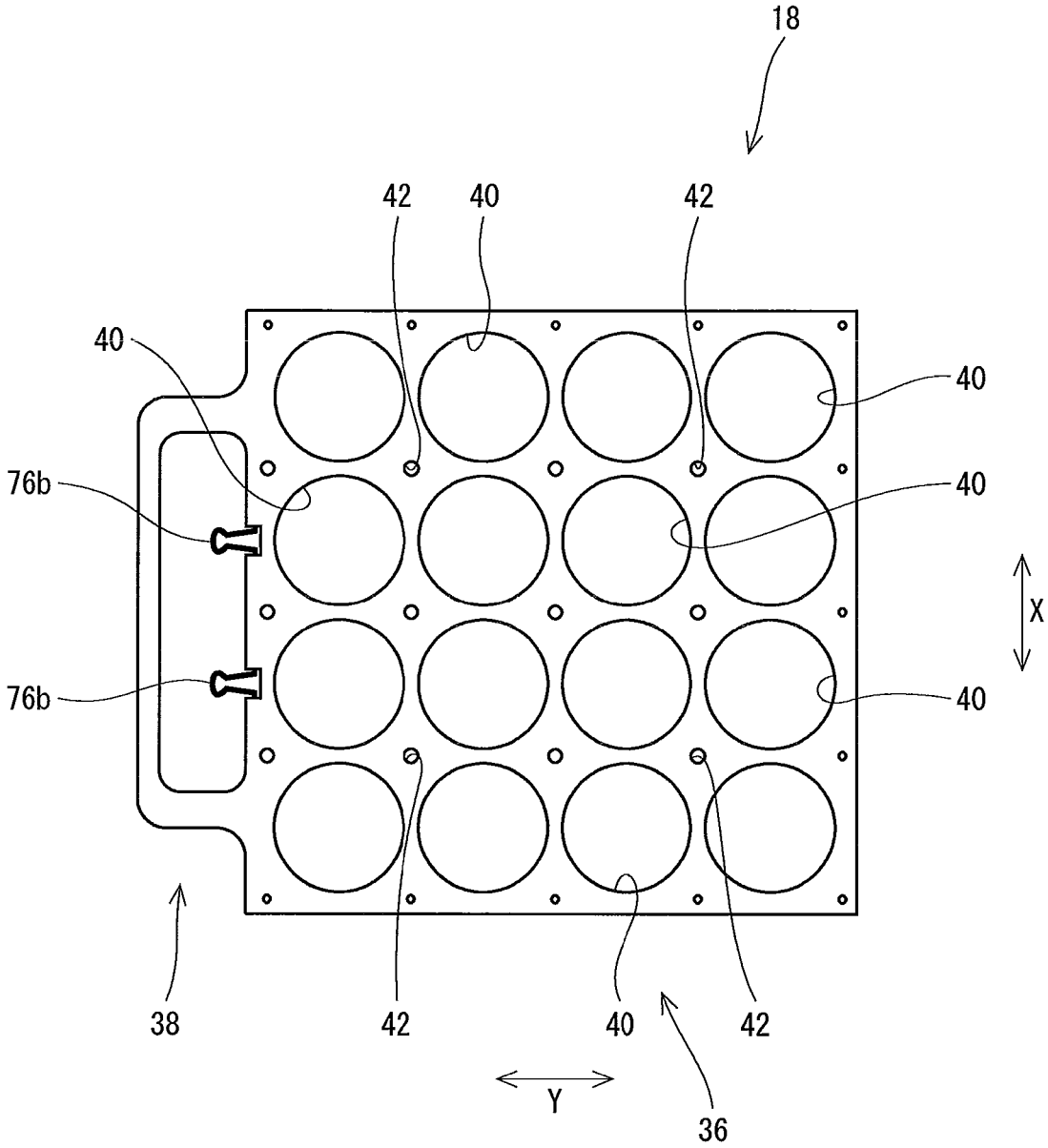
FIG. 7 is a plan view of a lower plate of the tray in FIG. 4.

FIG. 7 is a plan view of the lower plate 18 of the tray 2 in FIG. 4. The lower plate 18 is made of a substantially rectangular plate. The lower plate 18 includes a third main portion 36 and a third sub-portion 38. The third main portion 36 and the third sub-portion 38 are integrally formed with each other. The third main portion 36 forms a part of the main body 4. The third sub-portion 38 forms a part of the grip 6.

The third main portion 36 includes third main holes 40 and third sub-holes 42. The third main portion 36 is provided with 16 third main holes 40. The third main holes 40 extend through the third main portion 36 in the vertical direction. Each third main hole 40 has a circular cross-sectional shape. As shown in the drawing, four third main holes 40 are arranged in each line and at regular intervals in the X direction, and four third main holes 40 are arranged in each line and at regular intervals in the Y direction. Each of the third main holes 40 is provided at a position corresponding to the lower side of the corresponding second main hole 32 of the mid plate 16 in a state where the mid plate 16 is mounted on the lower plate 18.

The third main portion 36 is provided with four third sub-holes 42. Four third main holes 40 are located around each of the third sub-holes 42. Each of the third sub-holes 42 is provided at a position corresponding to the lower side of the corresponding second sub-hole 34 of the mid plate 16 in the state where the mid plate 16 is mounted on the lower plate 18. The third sub-holes 42 extend through the third main portion 36 in the vertical direction.

The lower plate 18 is formed by performing punching and the like on a plate that is formed from a resin composition. In the tray 2, in light of strength, the lower plate 18 is formed by processing a plate that is formed from a fiber-reinforced plastic. The lower plate 18 is hard. In the tray 2, the material of the lower plate 18 is the same as the material of the upper plate 14.

In the tray 2, the mid plate 16 is interposed between the upper plate 14 and the lower plate 18, and the upper plate 14, the mid plate 16, and the lower plate 18 are joined to each other by means of screws 44, to form the holder 10. In the holder 10, the upper plate 14, the mid plate 16, and the lower plate 18 are integral with each other.

Figure 8:
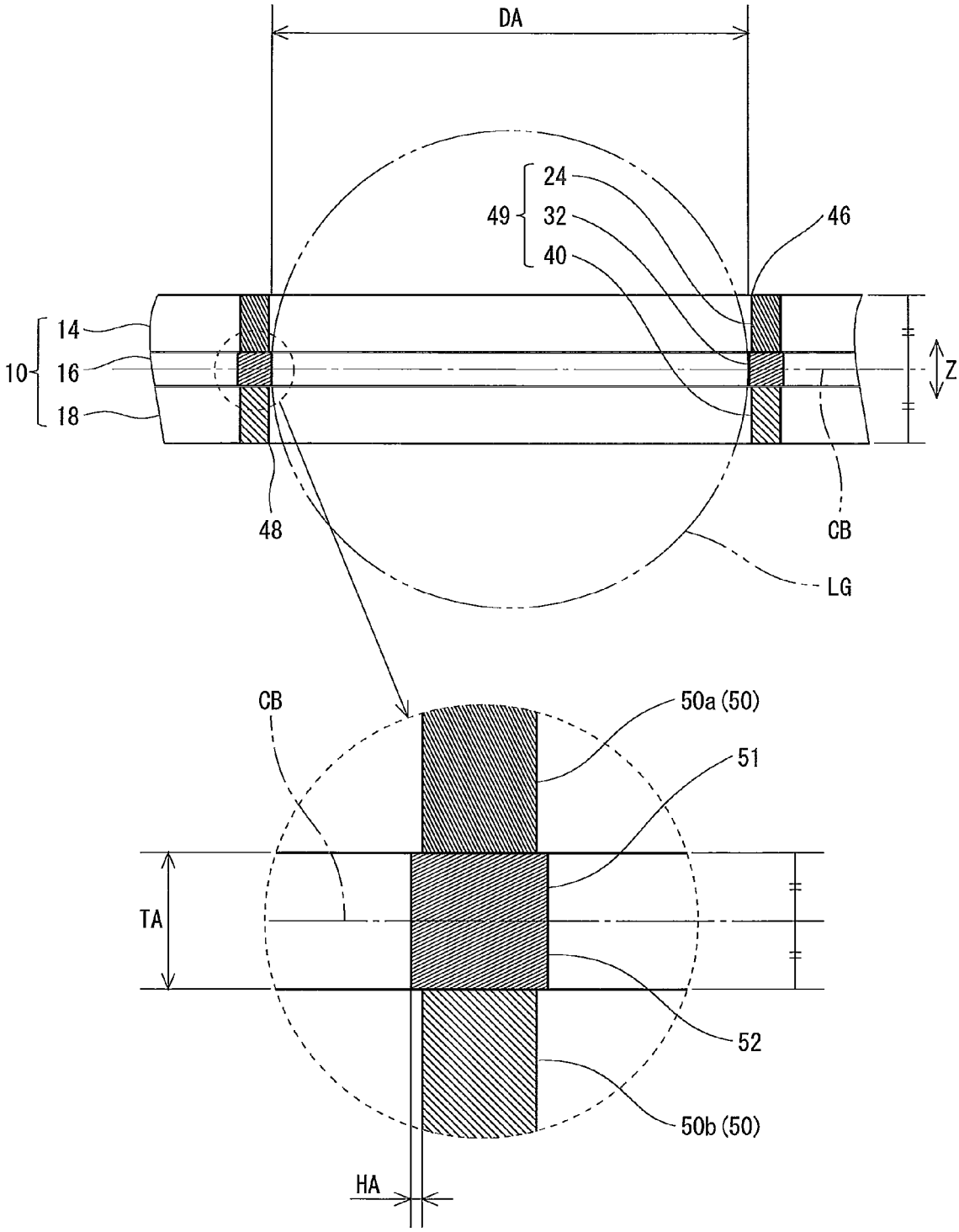
FIG. 8 is a partially enlarged cross-sectional view taken along the line VIII-VIII of FIG. 4.

FIG. 8 is a partially enlarged cross-sectional view taken along the line VIII-VIII of FIG. 4. FIG. 8 shows a part of the holder 10. In FIG. 8, an alternate long and short dash line CB represents the center line of the holder in the vertical direction. In the holder 10, the distance from the center line CB to the upper surface is the same as the distance from the center line CB to the lower surface. The position of the center line CB agrees with a position corresponding to half of the thickness of the holder 10. As shown in the drawing, in the holder 10, the mid plate 16 is located at a position where the center line CB passes. The mid plate 16 is located at the center of the thickness of the holder 10 in the Z direction. The position of the center line CB agrees with a position corresponding to half of the thickness of the mid plate 16. The mid plate 16 is located such that the center of the thickness thereof in the Z direction is located at the center of the thickness of the holder 10. The holder 10 is shaped so as to be vertically symmetrical about the center line CB.

In the holder 10, each second main hole 32 of the mid plate 16 is located on the lower side of the corresponding first main hole 24 of the upper plate 14. Each third main hole 40 of the lower plate 18 is located on the lower side of the corresponding second main hole 32. The first main hole 24, the second main hole 32, and the third main hole 40 are combined to form, in the holder 10, a first hole 49 that extends from an upper opening 46 of the first main hole 24 to a lower opening 48 of the third main hole 40. In other words, the holder 10 has the first hole 49 having: the upper opening 46 located in the upper surface of the holder 10; and the lower opening 48 located in the lower surface of the holder 10.

In the tray 2, the golf ball is to be set into the first hole 49 of the holder 10. In FIG. 8, an alternate long and two short dashes line LG represents a golf ball that has been set into the holder 10.

As shown in the drawing, the thickness of the holder 10 is smaller than the outer diameter of the golf ball LG. In the holder 10, the upper portion of the golf ball LG projects from the upper opening 46. In other words, the holder 10 has, in the upper surface thereof, the upper opening 46 from which the upper portion of the golf ball LG is exposed. In addition, the lower portion of the golf ball LG projects from the lower opening 48 in the holder 10. In other words, the holder 10 has, in the lower surface, the lower opening 48 from which the lower portion of the golf ball LG is exposed.

In the holder 10, the diameter of the first main hole 24 is larger than the outer diameter of the golf ball LG. Thus, an inner surface 50*a* of the first main hole 24 surrounds the set golf ball LG but does not come into contact with the golf ball LG. The diameter of the third main hole 40 is larger than the outer diameter of the golf ball LG. Thus, an inner surface 50*b* of the third main hole 40 also surrounds the set golf ball LG but does not come into contact with the golf ball LG. In other words, the first hole 49 of the holder 10 has an inner surface 50 that surrounds the golf ball LG.

As shown in the drawing, an inner surface 51 of the second main hole 32 is located inward of the inner surface 50*a* of the first main hole 24. The portion of the inner surface 51 of the second main hole 32 projects inwardly from the inner surface 50*a* of the first main hole 24. The inner surface 51 of the second main hole 32 is located inward of the inner surface 50*b* of the third main hole 40. The portion of the inner surface 51 of the second main hole 32 projects inwardly from the inner surface 50*b* of the third main hole 40. In the holder 10, the second main hole 32 is formed such that the size thereof is smaller than the size of the golf ball LG. Thus, the inner surface 51 of the second main hole 32 comes into contact with the golf ball LG. In other words, the first hole 49 of the holder 10 has a contact portion 52 that projects inwardly from the inner surface 50 and comes into contact with the golf ball LG.

As described above, each of the first main holes 24 of the upper plate 14 and the second main holes 32 of the mid plate 16 has a circular cross-sectional shape. Thus, the portion of the inner surface 51 of the second main hole 32 that projects from the inner surface 50*a* of the first main hole 24, has a ring shape. Because each third main hole 40 of the lower plate 18 also has a circular cross-sectional shape, the portion of the inner surface 51 of the second main hole 32 that projects from the inner surface 50*b* of the third main hole 40, has a ring shape. In other words, the portion of the inner surface 51 of the second main hole 32 forms a ring-shaped member. Thus, the contact portion 52 provided in the first hole 49 is made of a ring-shaped member. In addition, because the mid plate 16 is made of an elastic body, the contact portion 52 is an elastic body.

In a state where the golf ball LG is not set, the contact portion 52 of the first hole 49 is located inward of the surface of the golf ball LG when being set. When the golf ball LG is set into the holder 10, the golf ball LG presses outwardly the contact portion 52. Because the contact portion 52 is an elastic body, the contact portion 52 elastically deforms due to this pressing. The contact portion 52 squeezes the golf ball LG, and thus the golf ball LG is fixed to the holder 10. The set golf ball LG does not drop off from the holder 10 due to its own weight. The holder 10 can stably hold the golf ball LG.

As described above, the mid plate 16 forming a part of the holder 10 is located at the position where the center line CB of the holder 10 passes, and the position of the center line CB agrees with the position corresponding to half of the thickness of the mid plate 16. Thus, the center of the contact portion 52 in the thickness direction lies on the center line CB.

Figure 9:
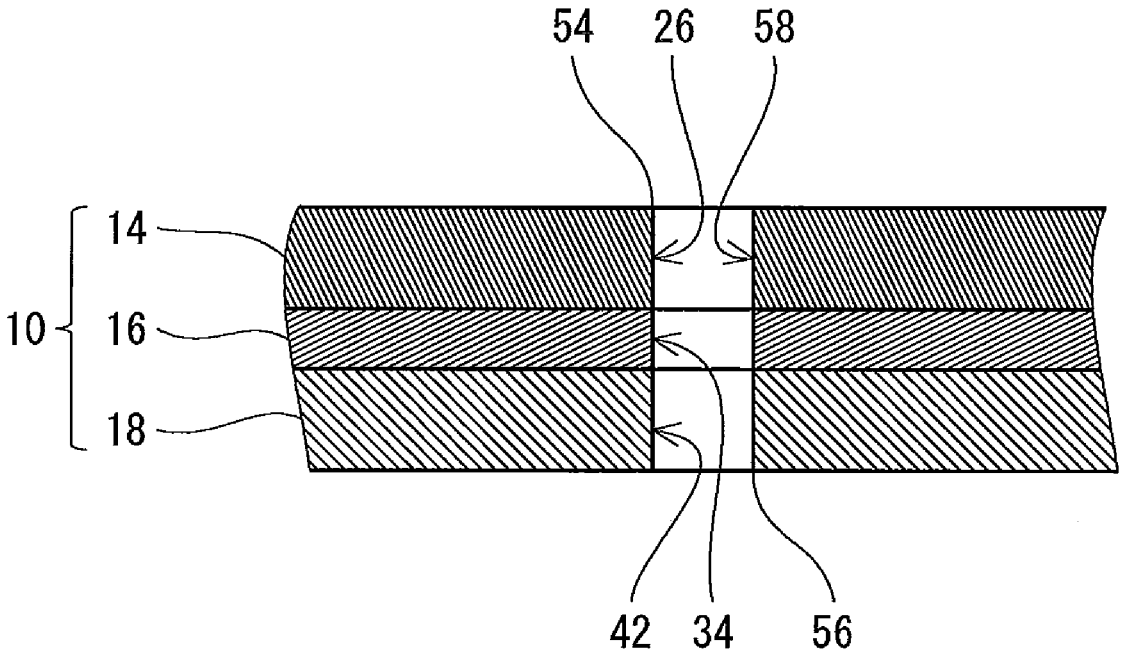
FIG. 9 is a partially enlarged cross-sectional view taken along the line IX-IX of FIG. 4.

FIG. 9 is a partially enlarged cross-sectional view taken along the line IX-IX of FIG. 4. FIG. 9 shows a part of the holder 10 that is different from the part of the holder 10 shown in FIG. 8. As shown in the drawing, in the holder 10 in which the upper plate 14, the mid plate 16, and the lower plate 18 are integral with each other, each second sub-hole 34 of the mid plate 16 is located on the lower side of the corresponding first sub-hole 26 of the upper plate 14. Each third sub-hole 42 of the lower plate 18 is located on the lower side of the corresponding second sub-hole 34. The first sub-hole 26, the second sub-hole 34, and the third sub-hole 42 are combined to form, in the holder 10, a second hole 58 that extends from an upper opening 54 of the first sub-hole 26 to a lower opening 56 of the third sub-hole 42. In other words, the holder 10 has the second hole 58 extending therethrough in the vertical direction. As described later, a pin of the base plate 12 is inserted through the second hole 58.

Figure 10:
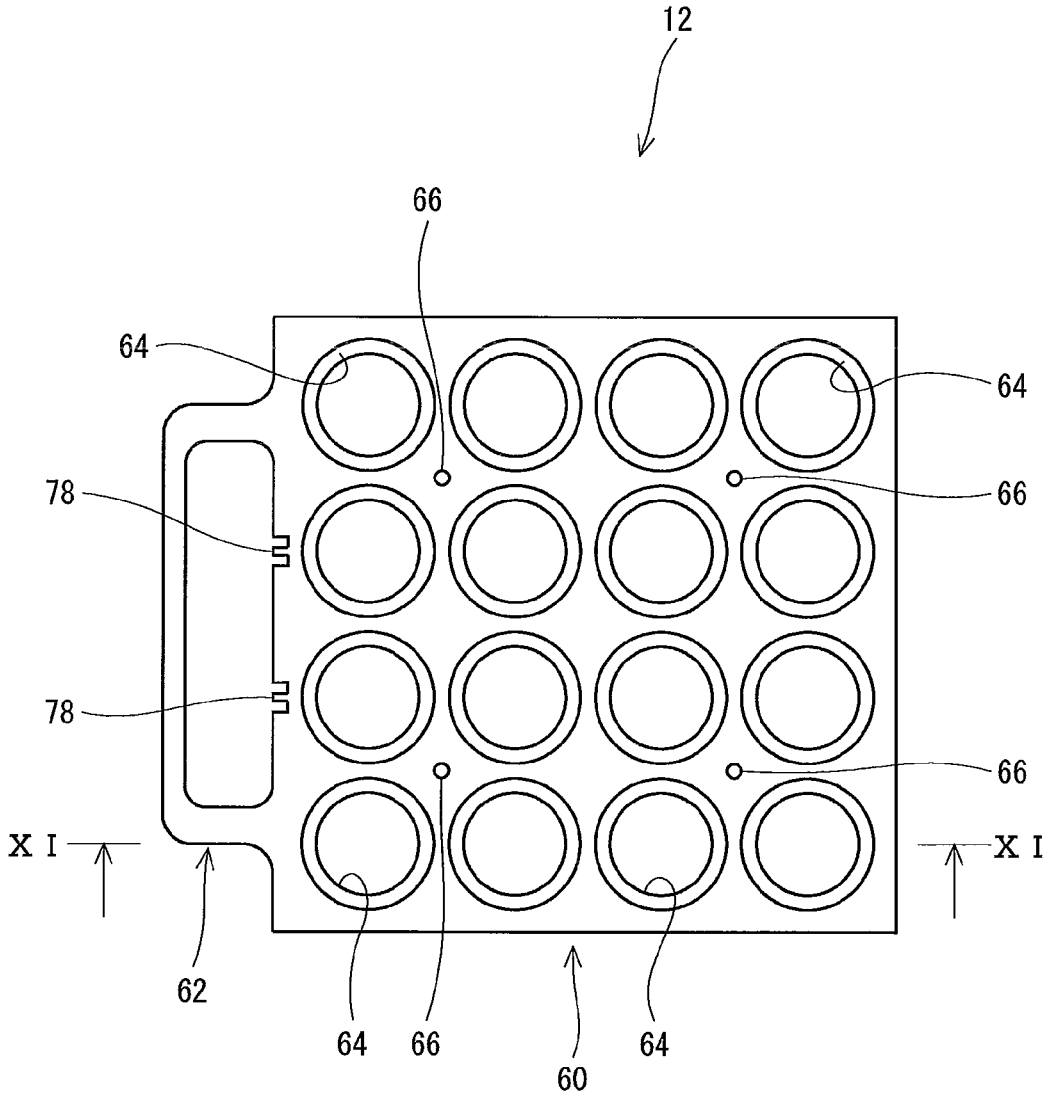
FIG. 10 is a plan view of a base plate.

FIG. 10 is a plan view of the base plate 12. The base plate 12 is made of a substantially rectangular plate. The base plate 12 includes a fourth main portion 60 and a fourth sub-portion 62. The fourth main portion 60 and the fourth sub-portion 62 are integrally formed with each other. The fourth main portion 60 forms a part of the main body 4. The fourth sub-portion 62 forms a part of the grip 6.

The fourth main portion 60 has fourth main holes 64 and pins 66. The fourth main holes 64 extend through the fourth main portion 60 in the vertical direction. Each fourth main hole 64 has a circular cross-sectional shape. The fourth main portion 60 is provided with 16 fourth main holes 64. As shown in the drawing, four fourth main holes 64 are arranged in each line and at regular intervals in the X direction, and four fourth main holes 64 are arranged in each line and at regular intervals in the Y direction. Each of the fourth main holes 64 is provided at a position corresponding to the lower side of the corresponding third main hole 40 of the lower plate 18 in a state where the lower plate 18 of the holder 10 is mounted on the base plate 12.

The fourth main portion 60 is provided with four pins 66. Four fourth main holes 64 are located around each of the pins 66. Each of the pins 66 is provided at a position corresponding to the lower side of the corresponding third sub-hole 42 of the lower plate 18 in the state where the lower plate 18 of the holder 10 is mounted on the base plate 12. As shown in FIG. 4, the pins 66 extend through the fourth main portion 60 in the vertical direction. The upper portion of each pin 66 extends upwardly from the upper surface of the fourth main portion 60.

The portion of the base plate 12 that consists of the fourth main portion 60 and the fourth sub-portion 62 is formed by performing punching and the like on a plate that is formed from a resin composition. In the tray 2, in light of strength, the portion that consists of the fourth main portion 60 and the fourth sub-portion 62 is formed by processing a plate that is formed from a fiber-reinforced plastic. The portion that consists of the fourth main portion 60 and the fourth sub-portion 62 is hard. In the tray 2, the material of the portion that consists of the fourth main portion 60 and the fourth sub-portion 62 is the same as the material of the upper plate 14.

Figure 11:
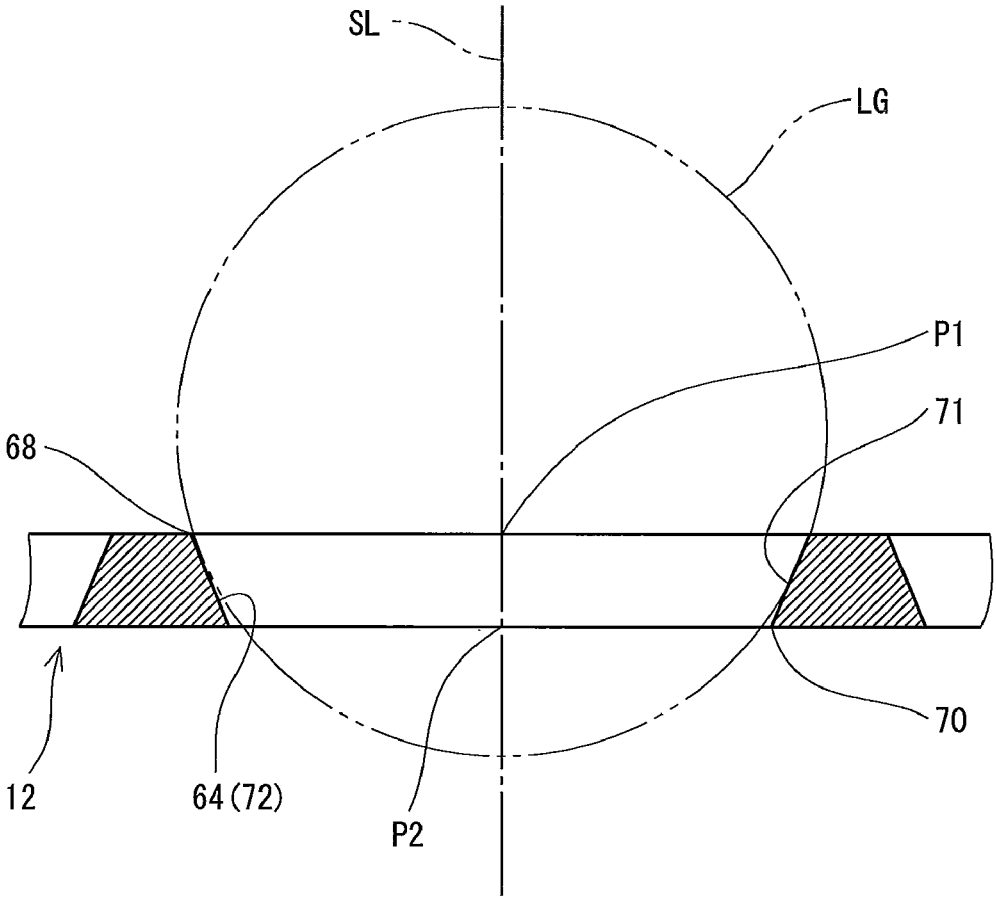
FIG. 11 is a partially enlarged cross-sectional view taken along the line XI-XI of FIG. 10.

FIG. 11 is a partially enlarged cross-sectional view taken along the line XI-XI of FIG. 10. FIG. 11 shows a part of the base plate 12 at the fourth main hole 64. In FIG. 11, a point P1 represents the center of an upper opening 68 of the fourth main hole 64. A point P2 represents the center of a lower opening 70 of the fourth main hole 64. An alternate long and short dash line SL represents the center line of the fourth main hole 64 that passes through the centers P1 and the P2.

As shown in the drawing, the size of the upper opening 68 of the fourth main hole 64 is larger than the size of the lower opening 70 thereof. The fourth main hole 64 is formed such that the distance from an inner surface 71 thereof to the center line SL gradually decreases toward the lower side. The fourth main hole 64 is shaped so as to be tapered toward the lower side. Specifically, the fourth main hole 64 is a tapered hole.

In the base plate 12, the golf ball LG is put on the inner surface 71 of the fourth main hole 64. As shown in the drawing, the lower portion of the golf ball LG comes into contact with the inner surface 71 of the fourth main hole 64. The size of the lower opening 70 of the fourth main hole 64 is smaller than the outer diameter of the golf ball LG. In the base plate 12, the golf ball LG put in the fourth main hole 64 does not drop off from the lower opening 70. The golf ball LG is put in the fourth main hole 64. In the present specification, the fourth main hole 64 is referred to as a stopper 72. In other words, the base plate 12 has the stopper 72 that comes into contact with the golf ball LG.

As shown in FIG. 1, the tray 2 further includes clamps 74. Each clamp 74 includes two loop pins 76 and a projection 78. One loop pin 76*a* is rotatably mounted to the upper plate 14. The other loop pin 76*b* is rotatably mounted to the lower plate 18. The projection 78 is provided in the base plate 12. In the tray 2, when the holder 10 is mounted on the base plate 12, the loop pin 76*a* and 76*b* are fitted onto the projections 78. Due to this fitting, the holder 10 is fixed to the base plate 12. In this manner, the tray 2 is made up of the holder 10 and the base plate 12.

As shown in FIG. 2, the tray 2 is shaped so as to be bilaterally symmetrical about the center line CA. As described above, the holder 10 is shaped so as to be vertically symmetrical about the center line CB. Thus, even when the holder 10 is inverted and then mounted on the base plate 12, the tray 2 is formed. The holder 10 is invertible.

Figure 12:
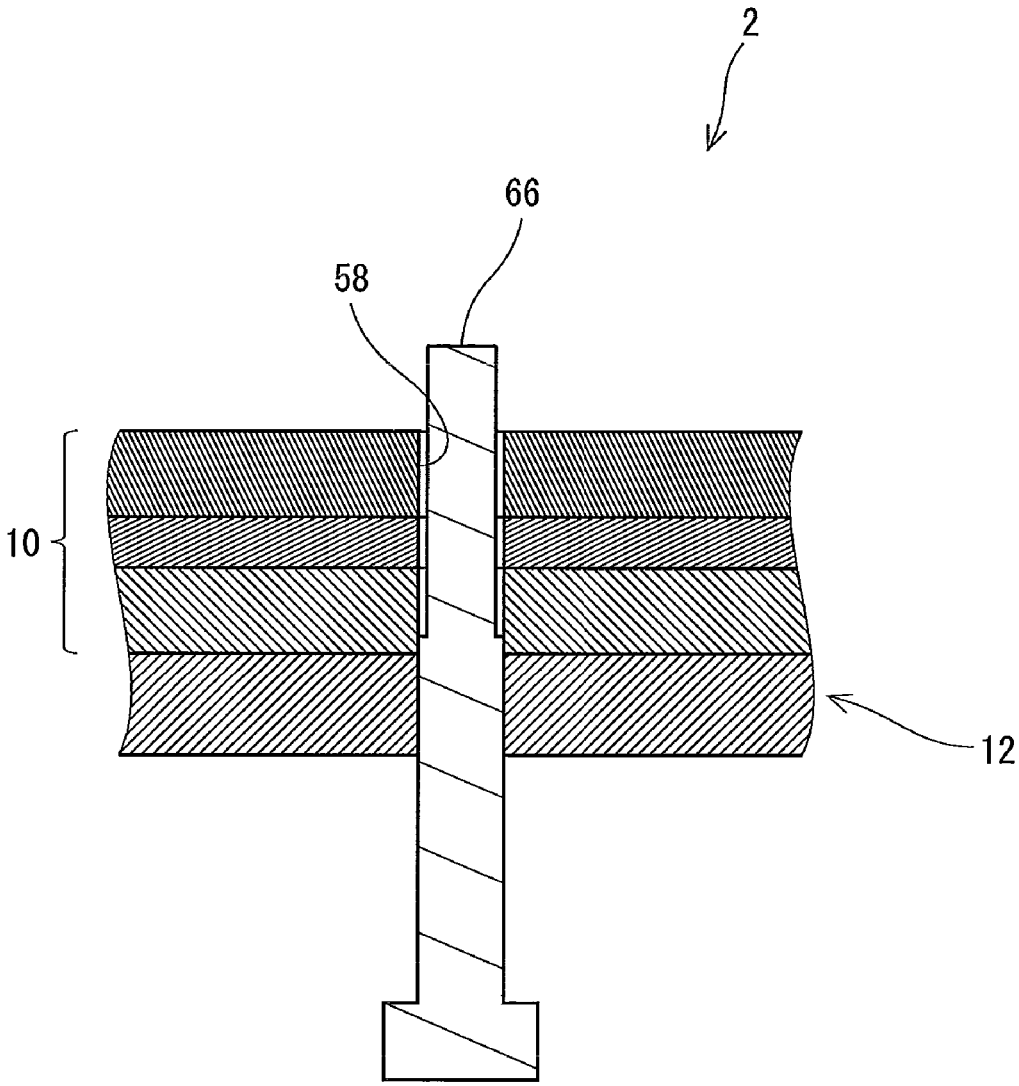
FIG. 12 is a partially enlarged cross-sectional view taken along the line XII-XII of FIG. 2.

FIG. 12 is a partially enlarged cross-sectional view taken along the line XII-XII of FIG. 2. FIG. 12 shows a part around the pin 66 that is provided as a part of the tray 2 in the base plate 12. In the tray 2, when the holder 10 is mounted on the base plate 12, the pin 66 is inserted through the second hole 58 of the holder 10. Due to the insertion of the pin 66, the holder 10 is prevented from being displaced relative to the base plate 12. In the tray 2, the four pins 66 are provided in the base plate 12, and each pin 66 is inserted through the corresponding second hole 58. Thus, the holder 10 is effectively prevented from being displaced relative to the base plate 12 in the X direction and in the Y direction.

As shown in the drawing, a gap is formed between the upper portion of the pin 66 and the second hole 58. The gap can contribute to insertion of the pin 66 into the second hole 58. In the tray 2, the holder 10 and the base plate 12 can be easily fitted together by lowering the holder 10 toward the base plate 12 with the position of each second hole 58 being matched with the position of the corresponding pin 66. The gap can also contribute to withdrawal of the pin 66 from the second hole 58. In the tray 2, the holder 10 can be easily separated from the base plate 12 by lifting the holder 10 from the base plate 12.

The golf ball LG having a mark is manufactured using the tray 2 as follows. In the method of manufacturing the golf ball LG having the mark, the golf ball LG is prepared. The golf ball LG is set into the tray 2.

Figure 13:
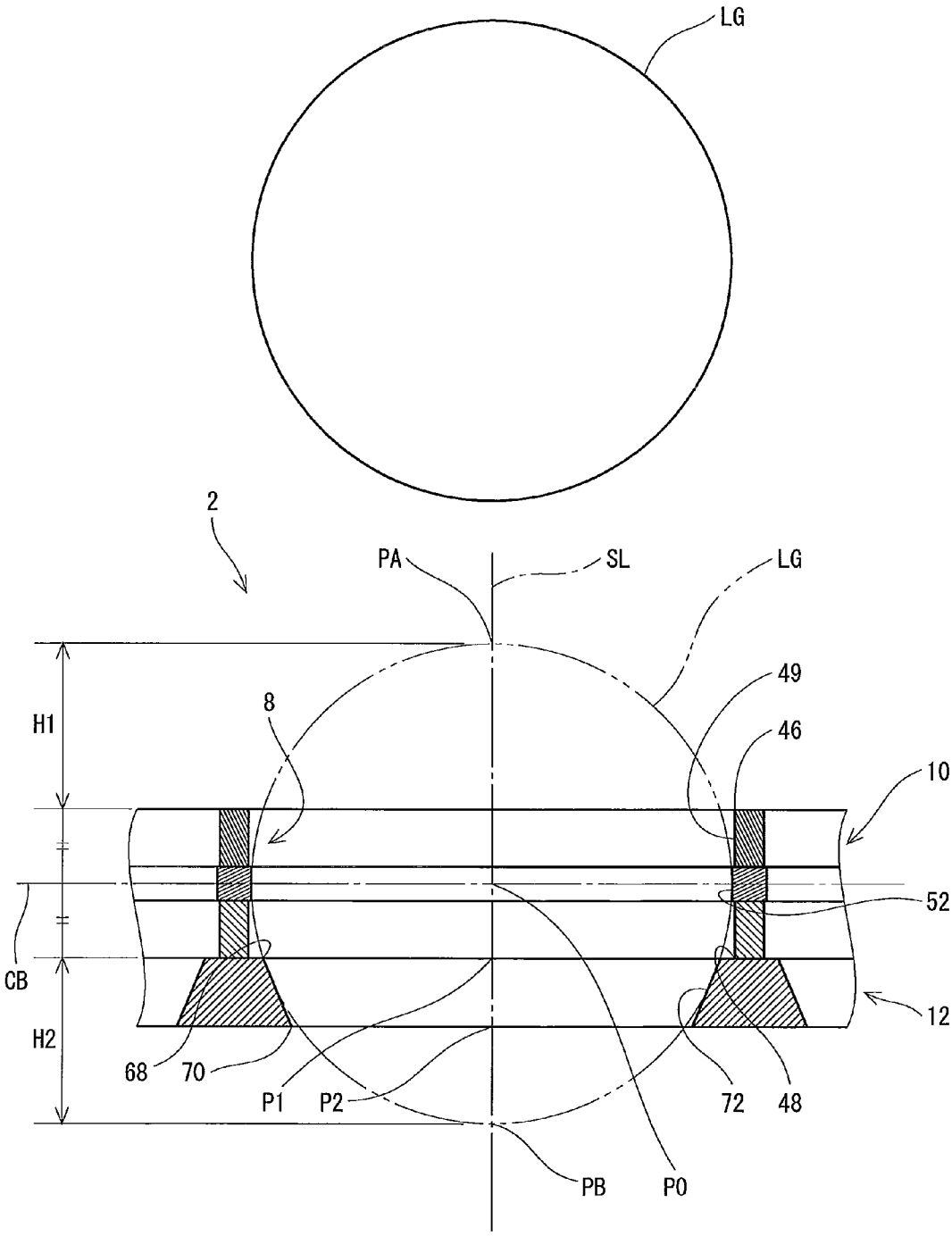
FIG. 13 is a partially enlarged cross-sectional view taken along the line XIII-XIII of FIG. 2.

FIG. 13 is a partially enlarged cross-sectional view taken along the line XIII-XIII of FIG. 2. FIG. 13 shows a part of the tray 2 at the cell 8, together with the golf ball LG. In the tray 2, the stopper 72 of the base plate 12 is located on the lower side of the first hole 49 of the holder 10. Due to this location, the cell 8 is formed so as to extend through the holder 10 in the vertical direction. In the cell 8, the golf ball LG is inserted through the upper opening 46 thereof.

The golf ball LG is downwardly squeezed into the cell 8 through the upper opening 46 toward the stopper 72, to be set into the cell 8. This squeezing is continued until the golf ball LG comes into contact with the stopper 72 to stop the movement thereof relative to the cell 8. In the golf ball LG put in the cell 8 in this manner, the upper portion of the golf ball LG is exposed from the upper opening 46 of the holder 10, and the lower portion of the golf ball LG is exposed from the lower opening 48 of the holder 10. Because the golf ball LG comes into contact with the contact portion 52 of the holder 10, the golf ball LG is fixed to the cell 8. In FIG. 13, a point P0 represents the center of the golf ball LG. A point PA represents the top of the golf ball LG on the upper side. A point PB represents the top of the golf ball LG on the lower side. A double ended arrow H1 represents the height from the upper surface of the holder 10 to the top PA. A double ended arrow H2 represents the height from the lower surface of the holder 10 to the top PB.

In the tray 2, the center P0 of the golf ball LG set into the cell 8 lies on the center line CB. As described above, the center line CB is located at the position corresponding to half of the thickness of the holder 10. In the tray 2, the golf ball LG is fixed to the holder 10 such that in the vertical direction, the position of the center P0 of the golf ball LG is caused to agree with the position of the center, in the thickness direction, of the holder 10 due to the contact with the stopper 72. Thus, in the tray 2, the height H1 is equal to the height H2.

In the tray 2, because the center, in the thickness direction, of the contact portion 52 lies on the center line CB, the contact portion 52 extends along a great circle of the golf ball LG. The contact portion 52 is located so as to extend along the great circle of the golf ball LG set into the cell 8. In the tray 2, the golf ball LG can be set at an appropriate position only by squeezing the golf ball LG into the cell 8. The tray 2 makes it easy to set the golf ball LG thereinto.

In the method of manufacturing the golf ball LG having the mark, the tray 2 into which the golf balls LG have been set is supplied to a print system.

Figure 14:
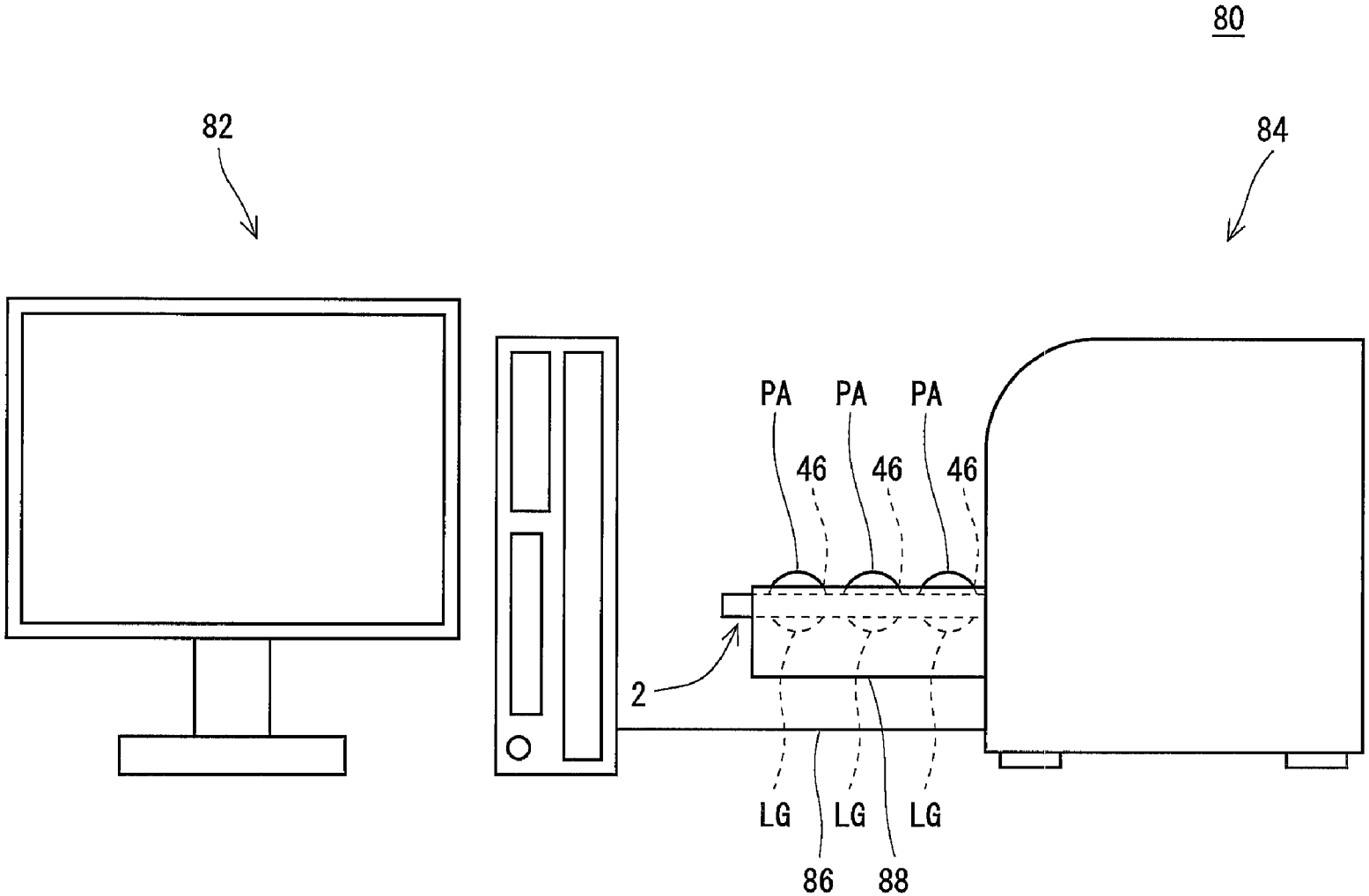
FIG. 14 is a schematic view of a print system used for a method of manufacturing a golf ball having a mark.

FIG. 14 is a schematic view of a print system 80 used for the method of manufacturing the golf ball LG having the mark. The print system 80 includes a personal computer 82 and an ink jet printer 84. The computer 82 and the printer 84 are connected to each other via a cable 86.

The printer 84 is an on-demand ink jet printer. Specifically, the printer 84 is trade name "LogoJET 5600R" available from LogoJET.ca.

The printer 84 includes a slide table 88 and a head (not shown) that discharges ink. The slide table 88 is moveable in the Y direction. The tray 2 is mounted on the slide table 88.

In order to form a mark by using the print system 80, first, the specifications of the mark are determined by using the computer 82. For example, a character or a graphic is inputted from an input means, such as a keyboard or a mouse, to determine the specifications of the mark. The specifications of the mark may be determined based on image data stored in a storage device (typically, a hard disk). The specifications of the mark may be transmitted to the computer 82 through a communication line (typically, the Internet) connected to the computer 82. The specifications of the mark may be determined based on an image read by a scanner. The specifications of the mark may be determined based on an image photographed by a digital camera.

After the specifications of the mark are determined, data of the specifications is transmitted to the printer 84 through the cable 86. The data includes an instruction to start printing, and information about the position and color of the mark. When the printer 84 receives the data, the slide table 88 moves to supply the tray 2 to the ink jet printer 84. Printing the mark onto the portion of the top PA of each golf ball LG, which is exposed from the upper opening 46 of the tray 2, is started. Although not shown in the drawing, the slide table 88 and the head concurrently but individually move during this printing. When the golf ball LG and a nozzle provided to the head reach a predetermined positional relationship, ink is discharged from the nozzle. The ink is moved to the golf ball LG to form the mark. When the printing of the mark is completed, the slide table 88 moves to eject the tray 2 from the printer 84.

Figure 15:
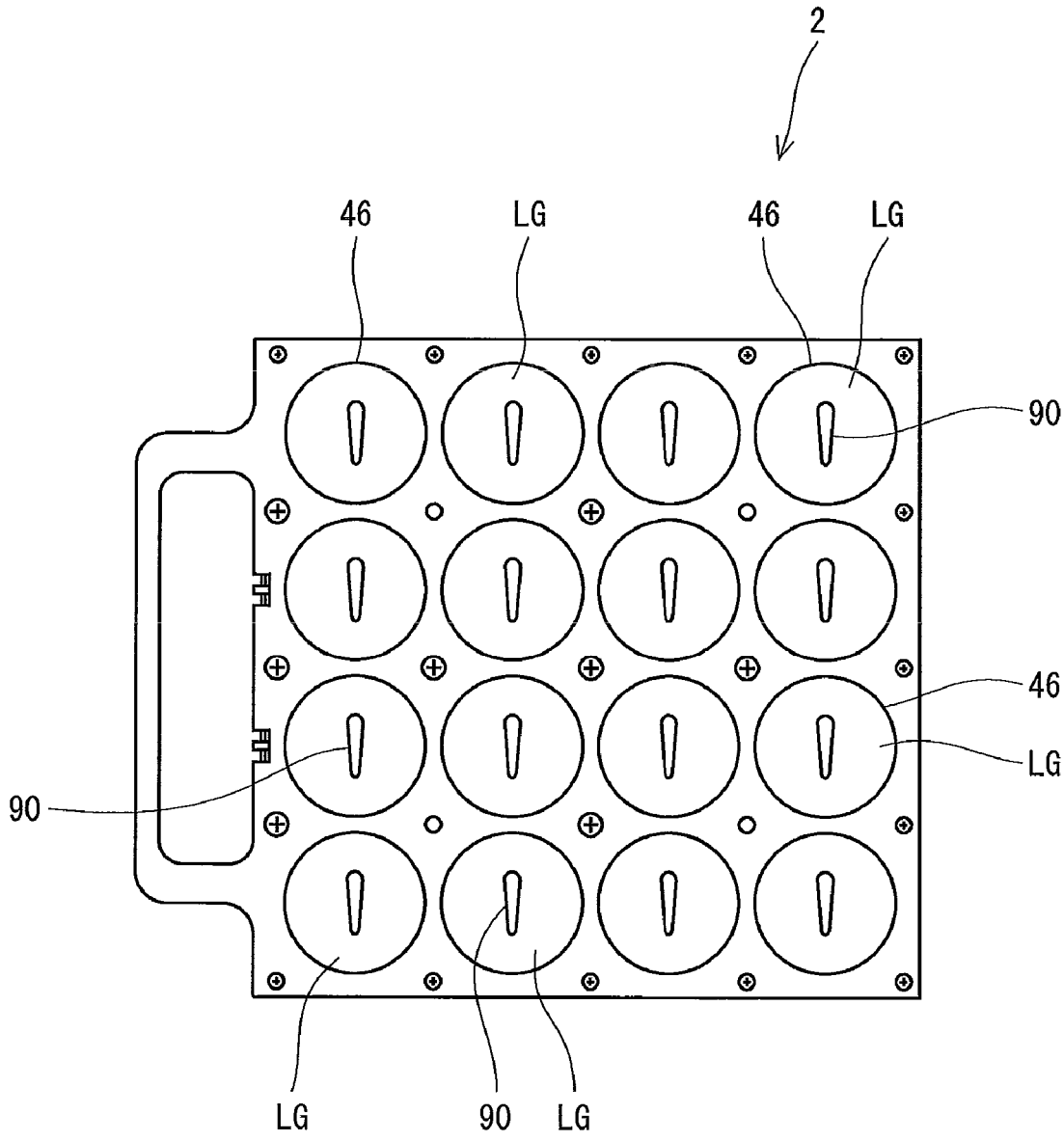
FIG. 15 is a plan view showing a state of the tray ejected from a printer.

FIG. 15 is a plan view showing a state of the tray 2 ejected from the printer 84. FIG. 15 shows an example of marks 90 printed on the upper portions of the golf balls LG exposed from the upper openings 46 of the holder 10. As shown in FIG. 13, in the tray 2, the top PA, the center P0, and the top PB of each golf ball LG supported by the stopper 72 lie on the center line SL of the stopper 72. In the tray 2, the mark 90 can be printed accurately at or near the top of each golf ball LG based on the position of the cell 8. The tray 2 can contribute to improvement of marking accuracy.

In the tray 2 ejected from the printer 84, the loop pins 76*a* and the loop pins 76*b* are released from the corresponding projections 78, and the holder 10 is separated from the base plate 12. Then, the holder 10 is inverted.

Figure 16:
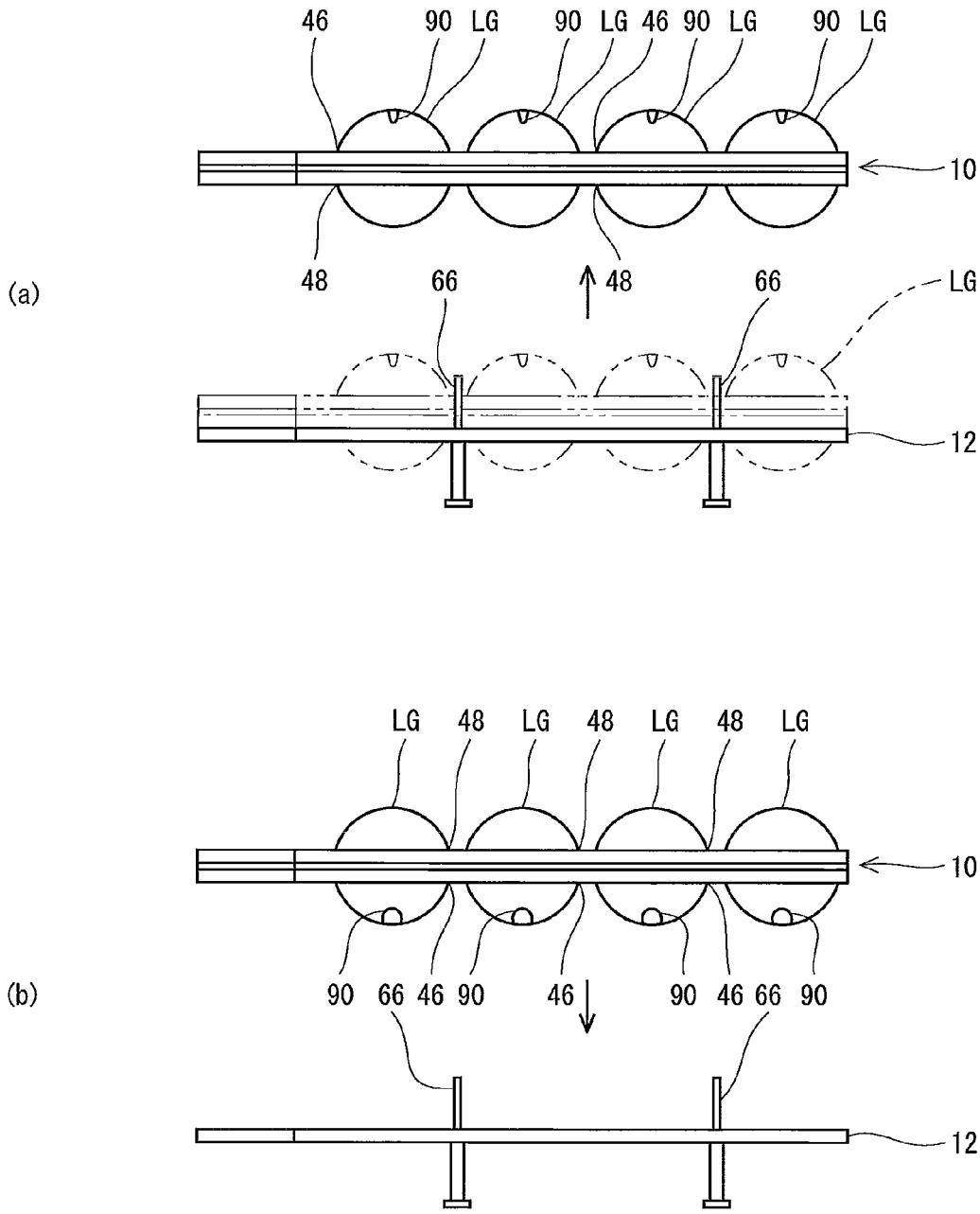
FIG. 16 is a side view showing an inverted state of the holder.
Figure 17:
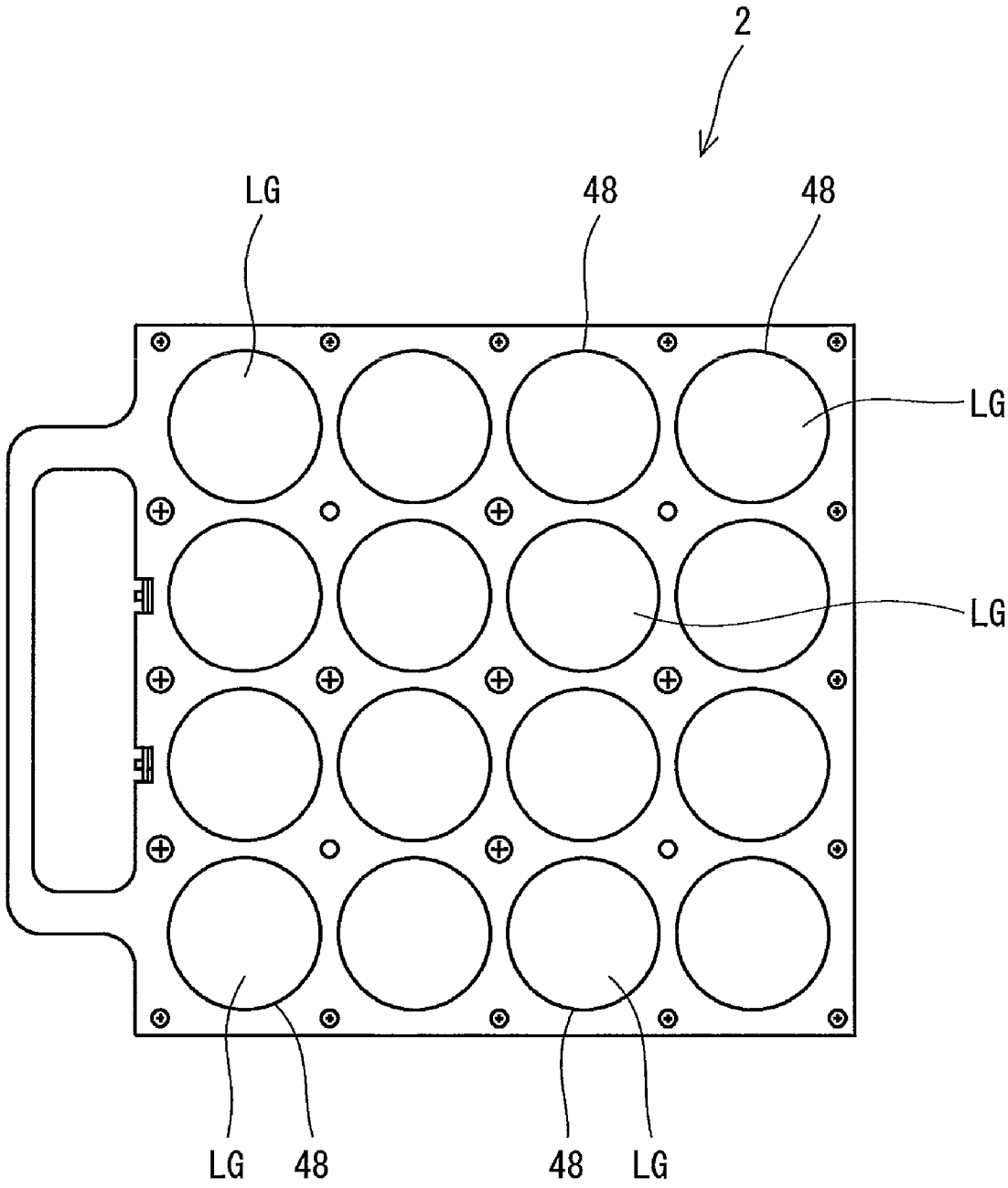
FIG. 17 is a plan view showing a state of the tray after inversion.

FIG. 16 is a side view showing an inverted state of the holder 10. FIG. 17 is a plan view showing a state of the tray 2 after inversion. As shown in the drawing, the holder 10 is lifted from the base plate 12 (see FIG. 16(*a*)). The holder 10 is inverted, and then mounted on the base plate 12 again (see FIG. 16(*b*)). Due to this inversion, the lower portions of the golf balls LG exposed from the lower openings 48 of the holder 10 are positioned on the upper surface of the tray 2 (see FIG. 17). In the tray 2, the contact portions 52 squeeze the golf balls LG to fix the golf balls LG to the holder 10. Thus, the holder 10 is inverted with the golf balls LG, on which the marks 90 have been printed, being fixed thereto.

In the manufacturing method, after the holder 10 is inverted, the loop pins 76*a* and the loop pins 76*b* are fitted onto the corresponding projections 78 to fix the holder 10 to the base plate 12. The tray 2 is mounted on the slide table 88 again. Upon receipt of data, such as the instruction to start printing, which is transmitted from the computer 82, the printer 84 prints the marks 90 on the lower portions of the golf balls LG that are not imprinted in the above printing process. In this manner, in the manufacturing method, the marks 90 are printed on both the upper side and the lower side of the golf balls LG.

In the manufacturing method, the contact portions 52 squeeze the golf balls LG to fix in place the golf balls LG. Thus, the golf balls LG set into the tray 2 do not move relative to the tray 2. In the tray 2, displacement of the golf balls LG due to vibrations and the like during printing is effectively suppressed. The tray 2 can contribute to the improvement of marking accuracy.

As described above, in the tray 2, the holder 10 is effectively prevented from being displaced relative to the base plate 12 in the X direction and in the Y direction. Thus, the tray 2 can effectively suppress displacement, in the X direction and the Y direction, of the golf balls LG set into the holder 10. The tray 2 can contribute to the improvement of marking accuracy.

In the manufacturing method, the holder 10 is inverted with the golf balls LG, on each of which the mark 90 has been printed, being fixed thereto. Thus, the marks 90 can easily be printed on both the upper side and the lower side of the golf balls LG. The tray 2 can contribute to workability of printing on both sides.

As described above, in the tray 2, each golf ball LG is fixed to the holder 10 such that the distance from the upper surface of the holder 10 to the top PA of the golf ball LG is equal to the distance from the lower surface of the holder 10 to the top PB of the golf ball LG. The distance from the nozzle, which is provided to the head of the printer 84, to the golf ball LG after the inversion is equal to that before the inversion. The tray 2 can contribute to workability of printing on both sides.

As described above, in the tray 2, the mark 90 can be printed accurately at or near the top of each golf ball LG based on the position of the cell 8. Thus, in the golf ball LG that has been subjected to printing on both sides by using the tray 2, the marks 90 can be formed at positions that are point-symmetrical to each other about the center P0. The tray 2 can contribute to the improvement of marking accuracy.

In FIG. 8, a double ended arrow DA represents the diameter of the contact portion 52. A double ended arrow TA represents the thickness of the contact portion 52. A double ended arrow HA represents the height of the contact portion 52 that projects from the inner surface of the first hole 49. The diameter DA, the thickness TA, and the height HA are measured in a state where the mid plate 16 is incorporated in the holder 10, not in a state before the mid plate 16 is incorporated in the holder 10.

From the standpoint that the contact portion 52 can stably hold the golf ball LG, the diameter DA is preferably equal to or greater than 42.00 mm, and is preferably equal to or less than 42.20 mm. The thickness TA is preferably equal to or greater than 2.90 mm, and is preferably equal to or less than 3.00 mm.

From the standpoint that the contact portion 52 can stably hold the golf ball LG, the height HA is preferably equal to or greater than 0.3 mm, more preferably equal to or greater than 0.4 mm, and particularly preferably equal to or greater than 0.5 mm. In light of durability of the contact portion 52, the height HA is preferably equal to or less than 0.8 mm, more preferably equal to or less than 0.7 mm, and particularly preferably equal to or less than 0.6 mm.

In the manufacturing method, from the standpoint that the contact portion 52 can stably hold the golf ball LG, the contact portion 52 has a hardness of preferably 40 or greater, more preferably 45 or greater, and even more preferably 50 or greater. In light of further improvement of durability, the hardness of the contact portion 52 is preferably equal to or less than 70, more preferably equal to or less than 68, and even more preferably equal to or less than 65.

The hardness of the contact portion 52 is measured according to the standards of "ASTM-D 2240-68" with a shore D type spring hardness scale mounted to an automated rubber hardness measurement machine (trade name "P1", available from Kobunshi Keiki Co., Ltd.). For the measurement, a slab formed by hot press and having a thickness of about 2 mm is used. A slab maintained at 23° C. for two weeks is used for the measurement. At the measurement, three slabs are stacked. A slab formed from the same resin composition as the resin composition of the contact portion 52 is used for the measurement.

The present invention is applicable to printing of marks for various balls.

The above description is merely for illustrative examples, and various modifications can be made without departing from the principles of the present invention.

What is claimed is:

1. A tray for an ink jet printer, the tray comprising:

a holder into which a golf ball is set, wherein the holder has: an upper surface with an opening from which a part of the golf ball is exposed; a lower surface with another opening from which another part of the golf ball is exposed; and an inner surface that surrounds the set golf ball with a contact portion that comes into contact with the golf ball to fix in place the golf ball, the contact portion projecting inwardly from the inner surface, and wherein the holder is invertible.

2. The tray according to claim 1, wherein the contact portion has a height of 0.3 mm or greater and 0.8 mm or less.

3. The tray according to claim 1, wherein the contact portion is located so as to extend along a great circle of the set golf ball.

4. The tray according to claim 1, wherein the contact portion is made of a ring-shaped member.

5. The tray according to claim 4, wherein the contact portion has a diameter of 42.00 mm or greater and 42.20 mm or less.

6. The tray according to claim 1, wherein the contact portion is an elastic body.

7. The tray according to claim 6, wherein the contact portion has a hardness of 40 or greater and 70 or less.

8. The tray according to claim 1, wherein a center of the contact portion in a thickness direction thereof is located at a position of a center of the holder in a thickness direction thereof.

9. The tray according to claim 8, wherein the contact portion has a thickness of 2.90 mm or greater and 3.00 mm or less.

10. The tray according to claim 1, further comprising a base plate on which the holder is mounted, wherein the base plate has a stopper that comes into contact with the golf ball that has been set into the holder, and the golf ball is fixed to the holder such that a position of a center of the golf ball is caused to agree with a position of a center of the holder in a thickness direction thereof due to this contact.

11. The tray according to claim 10, wherein the stopper is a tapered hole that is shaped so as to be tapered downwardly.

12. The tray according to claim 10, further comprising a clamp capable of fixing the holder to the base plate.

13. A method of manufacturing a golf ball having a mark, the method comprising the steps of:

putting a golf ball in a holder that has: an upper surface with a first opening that exposes a part of the golf ball; a lower surface with a second opening that exposes another part of the golf ball; and an inner surface that surrounds the set golf ball with an inwardly projecting contact portion to fix the golf ball to the holder;

supplying the holder to an ink jet printer and printing a mark at the part of the golf ball exposed by the first opening of the holder;

inverting the holder with the golf ball, on which the mark has been printed, being fixed thereto; and printing a mark at the part of the golf ball exposed by the second opening of the holder, by using the ink jet printer.

* * * * *